US007280079B2

(12) United States Patent
Miyagi

(10) Patent No.: US 7,280,079 B2
(45) Date of Patent: Oct. 9, 2007

(54) ADAPTER DEVICE FOR CAR RADIO

(75) Inventor: Hiroshi Miyagi, Tokyo (JP)

(73) Assignee: Neuro Solution Corp., Tokyo (JP)

( * ) Notice: Subject to any disclaimer, the term of this patent is extended or adjusted under 35 U.S.C. 154(b) by 101 days.

(21) Appl. No.: 11/326,028

(22) Filed: Jan. 4, 2006

(65) Prior Publication Data

US 2006/0152424 A1 Jul. 13, 2006

(30) Foreign Application Priority Data

Jan. 7, 2005 (JP) ..... 2005-002063

(51) Int. Cl.
*H01Q 1/32* (2006.01)

(52) U.S. Cl. ..... 343/711; 343/788; 343/821; 455/272

(58) Field of Classification Search ..... 343/711, 343/713, 821, 895, 788; 455/272, 34.5
See application file for complete search history.

(56) References Cited

U.S. PATENT DOCUMENTS

| | | | | |
|---|---|---|---|---|
| 5,121,504 | A * | 6/1992 | Toko | 455/575.9 |
| 5,155,494 | A * | 10/1992 | Bryant et al. | 343/713 |
| 6,850,148 | B2 * | 2/2005 | Masudaya | 340/5.61 |
| 2005/0151668 | A1 * | 7/2005 | Marty | 340/825.72 |
| 2006/0164210 | A1 * | 7/2006 | Ikeo | 340/5.72 |

* cited by examiner

*Primary Examiner*—Tan Ho
(74) *Attorney, Agent, or Firm*—James H. Walters

(57) ABSTRACT

An object of the invention is to provide an adaptor device for a car radio capable of improving the receiving state. The adaptor device 20 for a car radio is connected to a vehicle-mounted antenna connection terminal 12 provided in an FM radio receiver 10 installed within a vehicle room, and includes a signal line inserted between the vehicle-mounted antenna connection terminal 12 and a vehicle-mounted antenna 110; and an in-vehicle antenna 22 branching out from the signal line. A radio wave transmitted from an FM transmitter 40 disposed within the vehicle room via an antenna 42 is received by the radio receiver 10 via the in-vehicle antenna 22.

12 Claims, 4 Drawing Sheets

ADAPTER DEVICE FOR CAR RADIO

BACKGROUND OF THE INVENTION

1. Field of the Invention

The present invention relates to an adaptor device for a car radio connected to and for use in a vehicle-mounted car radio.

2. Description of the Related Art

There has hitherto been known an vehicle-mounted system in which an FM transmitter is connected to an audio reproducing player or the like and a radio wave transmitted from the FM transmitter is received by a car radio (for example, refer to Japanese Patent Laid-Open No. 6-309854). In this vehicle-mounted system, a vehicle-mounted antenna is used for the car radio to receive the radio wave.

In the above described vehicle-mounted system, however, a radio wave transmitted from the FM transmitter installed within the vehicle room is received by use of the vehicle-mounted antenna provided outside the vehicle body, so the receiving state deteriorates, thus causing a problem. In Japanese Patent Laid-Open No. 6-309854, there is a description such that since the FM transmitter and the vehicle-mounted antenna are very close to each other, reception can be performed by use of the vehicle-mounted antenna without trouble. However, the vehicle body is largely made of metal. In addition, a patterned conductor of heater for defrosting is often attached to the rear window. Thus a radio wave transmitted from the FM transmitter installed within the vehicle room hardly reaches the vehicle-mounted antenna disposed in the vicinity of the trunk or the like. Consequently, when the transmission level of a radio wave transmitted from the FM transmitter is low, satisfactory reception is difficult to achieve via the vehicle-mounted antenna.

SUMMARY OF THE INVENTION

The present invention has been achieved in view of the above described circumstances, and has an object to provide an adaptor device for a car radio capable of improving the receiving state.

To solve the above problem, an adaptor device for a car radio according to the present invention comprises a signal line connected to a vehicle-mounted antenna connection terminal provided in an FM radio receiver installed within the vehicle room and inserted between the vehicle-mounted antenna connection terminal and a vehicle-mounted antenna, and an in-vehicle antenna branching out from the signal line. By installing the adaptor device for a car radio between the FM radio receiver mounted on the vehicle and the vehicle-mounted antenna, the in-vehicle antenna can be connected to the FM radio receiver and a transmitting radio wave from an FM transmitter used within the vehicle room can be received via this in-vehicle antenna. Accordingly, the receiving state can be improved compared to when reception is performed via the vehicle-mounted antenna.

Preferably, the above described in-vehicle antenna is directly connected to the signal line, whereby a radio wave transmitted toward the interior of the vehicle room can be received more satisfactorily with a simple configuration.

Preferably, a balun is further provided which is inserted in the path of the above described signal line, and the signal line and the in-vehicle antenna are connected to each other via the balun, whereby impedance matching can easily be achieved when both the vehicle-mounted antenna and the in-vehicle antenna are connected to the FM radio receiver, and the FM radio receiver can efficiently receive signals corresponding to radio waves received via the vehicle-mounted antenna and the in-vehicle antenna, respectively.

Preferably, the above described in-vehicle antenna is a wire composed of a flexible metal conductor covered with an insulating member and is exposed to the outside from a housing having housed therein the signal line, whereby the in-vehicle antenna withdrawn from the adaptor device for a car radio can easily be housed in an empty space within the dashboard.

Preferably, the above described in-vehicle antenna is a wire composed of an inflexible metal conductor covered with an insulating member and is disposed outside the housing having housed therein the signal line and positioned substantially parallel to the longitudinal direction of the housing, whereby the protrusion of the in-vehicle antenna toward the outside of the adaptor device for a car radio can be reduced.

Preferably, the above described in-vehicle antenna is a conductor attached to the surface or rear surface of the housing having housed therein the signal line, whereby the in-vehicle antenna can be prevented from protruding from the adaptor device for a car radio toward the outside.

Preferably, the above described in-vehicle antenna is formed in a spiral manner across the surface or rear surface of the housing, whereby the length of the in-vehicle antenna can be secured and at the same time the in-vehicle antenna can be prevented from protruding toward the outside of the housing.

Preferably, the above described in-vehicle antenna is a bar antenna composed of a coil wound around a magnetic core and is disposed within the housing having housed therein the signal line, whereby the size of the in-vehicle antenna can be reduced to be surely housed in the housing.

Preferably, the above described housing is formed by use of a flexible member, whereby the adaptor device for a car radio can be installed by utilizing a narrow space within the dashboard.

DETAILED DESCRIPTION OF THE PREFERRED EMBODIMENTS

Figure 1:
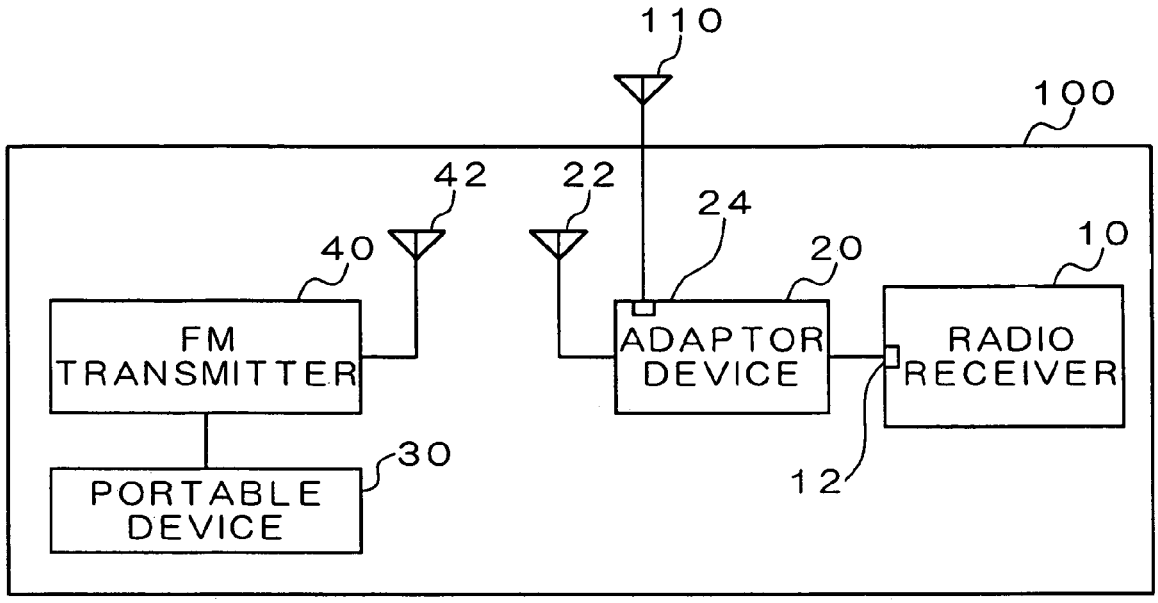
FIG. 1 is a view showing the overall configuration of a vehicle-mounted system having included therein an adaptor device for a car radio according to one embodiment.

An adaptor device for a car radio according to one embodiment of the present invention will be described below in detail with reference to the drawings. FIG. 1 is a view showing the overall configuration of a vehicle-mounted system having included therein an adaptor device for a car radio according to one embodiment. The vehicle-mounted system shown in FIG. 1 comprises a radio receiver 10 mounted on a vehicle 100, an adaptor device 20, a portable device 30 and an FM transmitter 40. The radio receiver 10 is installed in the dashboard of the vehicle 100, and receives FM radio broadcasts and AM radio broadcasts to output sound signals corresponding to the respective broadcast contents. These sound signals are outputted from a loudspeaker (not shown) mounted on the vehicle 100 toward the interior of the vehicle room. The radio receiver 10 includes a vehicle-mounted antenna connection terminal 12. A vehicle-mounted antenna 110 exposed to the outside of the vehicle 100 body is connected to this connection terminal 12 via the adaptor device 20.

Figure 2:
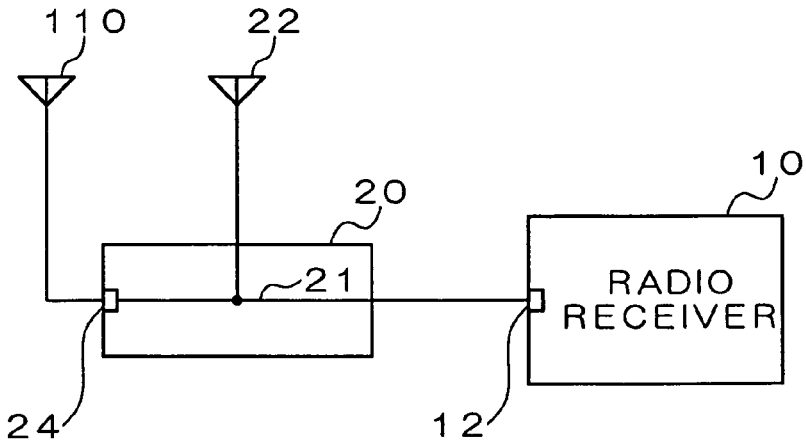
FIG. 2 is a view showing the configuration of the adaptor device.

The adaptor device 20 is installed between the radio receiver 10 and the vehicle-mounted antenna 110, and is used for causing an in-vehicle antenna 22 to branch out. FIG. 2 is a view showing the configuration of the adaptor device 20. As shown in FIG. 2, the adaptor device 20 comprises a signal line 21 inserted between the vehicle-mounted antenna 110 and the connection terminal 12 provided in the radio receiver 10, and the in-vehicle antenna 22 branching out from the signal line 21. In the present embodiment, the branching point of the in-vehicle antenna 22 is disposed at the intermediate position of the signal line 21 composed of a co-axial cable or the like. To connect the vehicle-mounted antenna 110, the adaptor device 20 further comprises a connection terminal 24 connected to one end of the signal line 21. The connection terminal 24 has the same configuration as the connection terminal 12 provided in the radio receiver 10. Thus the following advantage is obtained. In the conventional art (when the adaptor device 20 is not used), one end of the connection line in the vehicle-mounted antenna 110 side is connected to the connection terminal 12 of the radio receiver 10. Meanwhile, when the adaptor device 20 is used, it is sufficient to change the connecting destination to the connection terminal 24 of the adaptor device 20; the wiring configuration in the vehicle-mounted antenna 110 side needs not to be modified at all.

The portable device 30 shown in FIG. 1 is an audio device, a mobile telephone or the like carried by a passenger such as a driver. A sound signal outputted therefrom is supplied to the FM transmitter 40. The FM transmitter 40 applies FM modification to the sound signal supplied from the portable device 30 and outputs the resultant signal via an antenna 42.

As described above, by installing the adaptor device 20 between the radio receiver 10 mounted on the vehicle 100 and the vehicle-mounted antenna 110, the in-vehicle antenna 22 is connected to the radio receiver 10, and a transmitting radio wave from the FM transmitter 40 used within the vehicle room can be received by the radio receiver 10 via the in-vehicle antenna 22. Accordingly, the receiving state can be improved compared to when reception is performed via the vehicle-mounted antenna 110. Particularly, by connecting the in-vehicle antenna 22 directly to the signal line 21 disposed within the adaptor device 20, a radio wave transmitted toward the interior of the vehicle room can be received more satisfactorily with a simple configuration.

Figure 3:
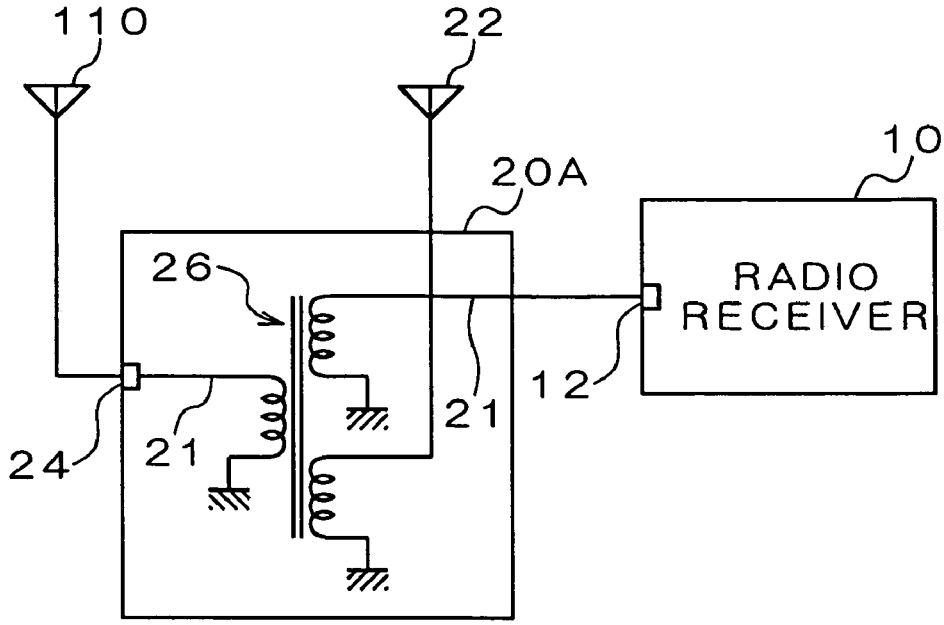
FIG. 3 is a view showing a variation of the adaptor device.

FIG. 3 is a view showing a variation of the adaptor device. The adaptor device 20A shown in FIG. 3 comprises a balun 26. The balun 26 is an impedance converting transformer, in which a coil in the primary side is connected to the vehicle-mounted antenna 110 via a connection terminal 24, and one coil in the secondary side is connected to the radio receiver 10, and the other coil to the in-vehicle antenna 22.

Figure 4:
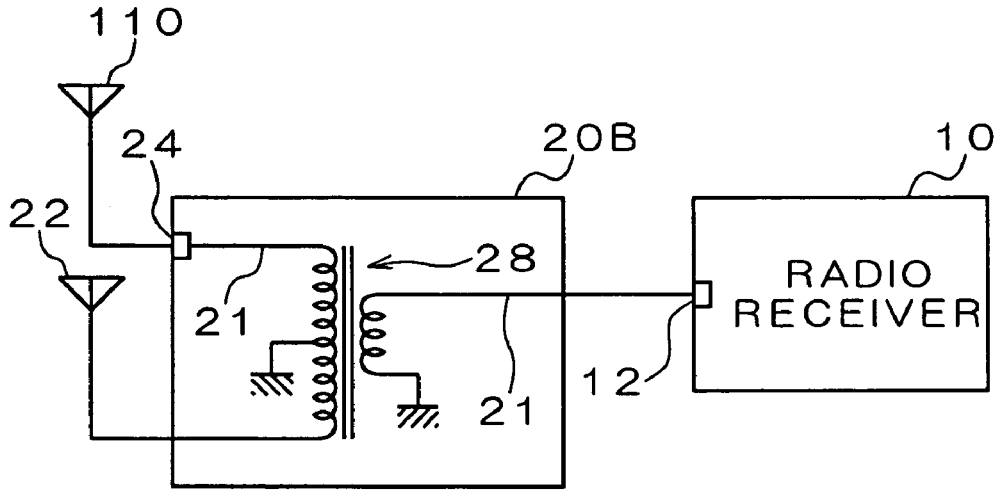
FIG. 4 is a view showing another variation of the adaptor device.

FIG. 4 is a view showing another variation of the adaptor device. The adaptor device 20B shown in FIG. 4 comprises a balun 28. The balun 28 has a different configuration than the balun 26 shown in FIG. 3. In the balun 28, a tap provided in a coil in the primary side is connected to the ground, and one end of this coil is connected to the vehicle-mounted antenna 110, and the other end to the in-vehicle antenna 22. A coil in the secondary side is connected to the radio receiver 10.

By using the balun 26 shown in FIG. 3 or the balun 28 shown in FIG. 4 in this way, impedance matching can easily be achieved when both the vehicle-mounted antenna 110 and the in-vehicle antenna 22 are connected to the radio receiver 10 via the adaptor device 20A or 20B. Thus it is possible to reduce the loss of signals corresponding to radio waves received by the vehicle-mounted antenna 110 and the in-vehicle antenna 22, respectively, and efficiently supply the signals to the radio receiver 10.

Figure 5:
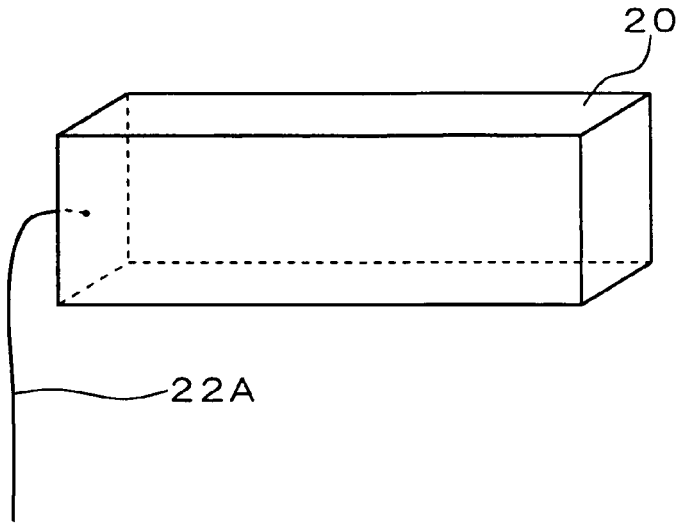
FIG. 5 is a view showing a concrete example of in-vehicle antenna connected to the adaptor device.

FIG. 5 is a view showing a concrete example of in-vehicle antenna connected to the adaptor device 20. The in-vehicle antenna 22A shown in FIG. 5 is a wire composed of a flexible metal conductor covered with an insulating member and is exposed to the outside from a housing of the adaptor device 20, whereby the in-vehicle antenna 22A withdrawn from the adaptor device 20 can easily be housed in an empty space within the dashboard.

Figure 6:
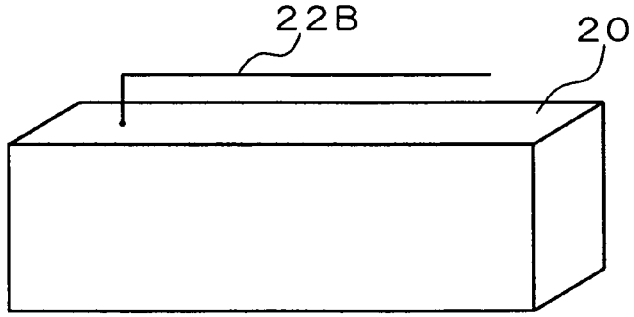
FIG. 6 is a view showing another concrete example of in-vehicle antenna connected to the adaptor device.

FIG. 6 is a view showing another concrete example of in-vehicle antenna connected to the adaptor device 20. The in-vehicle antenna 22B shown in FIG. 6 is a wire composed of an inflexible metal conductor covered with an insulating member and is disposed outside the housing of the adaptor device 20 and positioned substantially parallel to the longitudinal direction of the housing, whereby the protrusion of the in-vehicle antenna 22B toward the outside of the adaptor device 20 can be reduced.

Figure 7:
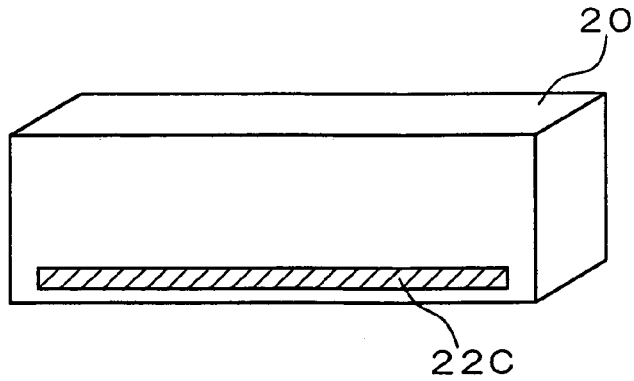
FIG. 7 is a view showing another concrete example of in-vehicle antenna connected to the adaptor device.

FIG. 7 is a view showing another concrete example of in-vehicle antenna connected to the adaptor device 20. The in-vehicle antenna 22C shown in FIG. 7 is attached to the surface of the housing of the adaptor device 20, whereby the in-vehicle antenna 22C can be prevented from protruding from the adaptor device 20 toward the outside. The in-vehicle antenna 22C may be attached to the rear surface (the inner surface) of the housing.

Figure 8:
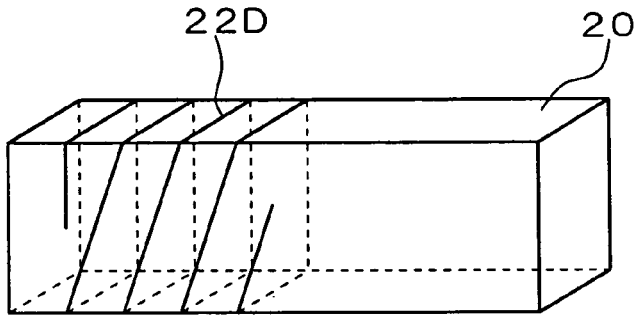
FIG. 8 is a view showing another concrete example of in-vehicle antenna connected to the adaptor device.

FIG. 8 is a view showing another concrete example of in-vehicle antenna connected to the adaptor device 20. The in-vehicle antenna 22D shown in FIG. 8 is formed in a spiral manner across the surface of the housing of the adaptor device 20, whereby the length of the in-vehicle antenna 22D can be secured and at the same time the in-vehicle antenna 22D can be prevented from protruding toward the outside of the housing. The in-vehicle antenna 22D may be attached to the rear surface (the inner surface) of the housing.

Figure 9:
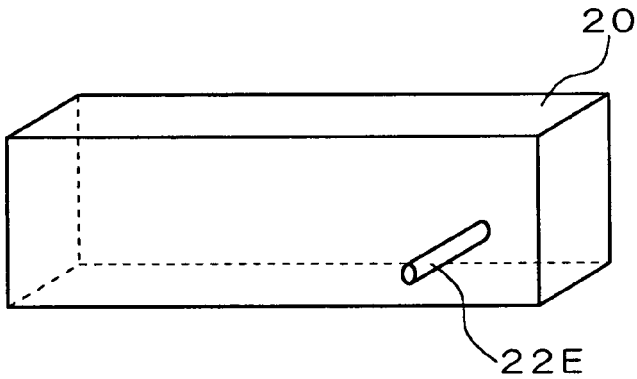
FIG. 9 is a view showing another concrete example of in-vehicle antenna connected to the adaptor device.

FIG. 9 is a view showing another concrete example of in-vehicle antenna connected to the adaptor device 20. The in-vehicle antenna 22E shown in FIG. 9 is a bar antenna composed of a coil wound around a magnetic core, such as a ferrite core, and is disposed within the housing of the adaptor device 20, whereby the size of the in-vehicle antenna 22E can be reduced to be surely housed within the housing.

The present invention is not limited to the above described embodiments, and many modifications to the embodiments are possible without departing from the gist of the invention. For example, the housing of the adaptor device 20 may be formed by use of a flexible member, whereby it is possible to utilize a narrow space within the dashboard in the back of the radio receiver 10 and thereby adjust and modify the configuration of the housing to that of the space. Thus the adaptor device 20 can easily be installed.

According to the above described embodiments, in the examples shown in FIGS. 5 to 8, the antenna 22A to 22D is formed in the exterior of or on the surface of the housing of the adaptor device 20. However, the antenna may be incorporated into the interior of the housing. Preferably, a variety of the in-vehicle antennas 22A etc. shown in FIGS. 5 to 9 are disposed in a direction such that the receiving state is made satisfactory relative to the antenna 42 provided in the FM transmitter 40. For example, the in-vehicle antenna 22B shown in FIG. 6, the in-vehicle antenna 22C shown in FIG. 7, and the in-vehicle antenna 22E shown in FIG. 9 are preferably disposed so that the longitudinal direction thereof is made substantially perpendicular to the direction of placement of the antenna 42. Also, the antenna 22D shown in FIG. 8 is preferably disposed so that the center line of the spiral configuration thereof is made substantially parallel to the direction of placement of the antenna 42.

In the above described embodiments, the in-vehicle antenna 22 etc. are connected to the signal line 21 within the adaptor device directly or via the balun 26 or 28. However, the in-vehicle antenna 22 etc. may be connected via a loading coil.

Figure 10:
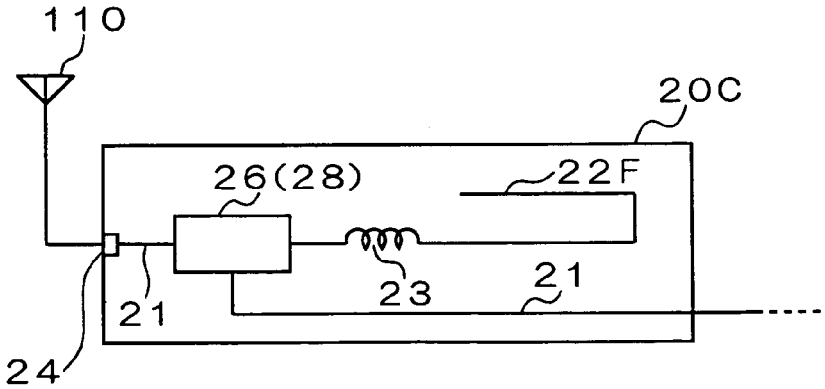
FIG. 10 is a view showing a concrete example of adaptor device having incorporated therein a loading coil.

FIG. 10 is a view showing a concrete example of adaptor device having incorporated therein a loading coil. The adaptor device 20C shown in FIG. 10 comprises a signal line 21, a balun 26 (or a balun 28), an incorporated U-shaped (or linear) in-vehicle antenna 22F, and a loading coil 23 inserted between the balun 26 and the in-vehicle antenna 22F. By virtue of provision of the loading coil 23, the effective length of the entire antenna composed of the loading coil 23 and in-vehicle antenna 22F can be increased. Thus a shorter in-vehicle antenna 22F can be used. Consequently, the in-vehicle antenna 22F can easily be incorporated into the adaptor device 20C and at the same time the size of the adaptor device 20C can be reduced. A loading coil 23 may be added to a variety of the adaptor devices shown in FIGS. 2 to 8.

What is claimed is:

1. An adaptor device for a car radio connected to a vehicle-mounted antenna connection terminal provided in an FM radio receiver installed within a vehicle room, the adaptor device comprising:

a signal line inserted between the vehicle-mounted antenna connection terminal and a vehicle-mounted antenna; and an in-vehicle antenna branching out from the signal line, wherein the in-vehicle antenna is connected to the signal line via a loading coil.

2. An adaptor device for a car radio connected to a vehicle-mounted antenna connection terminal provided in an FM radio receiver installed within a vehicle room, the adaptor device comprising:

a signal line inserted between the vehicle-mounted antenna connection terminal and a vehicle-mounted antenna; and an in-vehicle antenna branching out from the signal line, further comprising a balun inserted in the path of the signal line, wherein the signal line and the in-vehicle antenna are connected to each other via the balun.

3. The adaptor device for a car radio according to claim 2, wherein a loading coil is inserted between the balun and the in-vehicle antenna.

4. An adaptor device for a car radio connected to a vehicle-mounted antenna connection terminal provided in an FM radio receiver installed within a vehicle room, the adaptor device comprising:

a signal line inserted between the vehicle-mounted antenna connection terminal and a vehicle-mounted antenna; and an in-vehicle antenna branching out from the signal line, wherein the in-vehicle antenna is a wire composed of a flexible metal conductor covered with an insulating material and is exposed to the outside from a housing having housed therein the signal line.

5. The adaptor device for a car radio according to claim 4, wherein the housing is formed by use of a flexible member.

6. An adaptor device for a car radio connected to a vehicle-mounted antenna connection terminal provided in an FM radio receiver installed within a vehicle room, the adaptor device comprising:

a signal line inserted between the vehicle-mounted antenna connection terminal and a vehicle-mounted antenna; and an in-vehicle antenna branching out from the signal line, wherein the in-vehicle antenna is a wire composed of an inflexible metal conductor covered with an insulating material and is disposed outside a housing having housed therein the signal line and positioned substantially parallel to the longitudinal direction of the housing.

7. The adaptor device for a car radio according to claim 6, wherein the housing is formed by use of a flexible member.

8. An adaptor device for a car radio connected to a vehicle-mounted antenna connection terminal provided in an FM radio receiver installed within a vehicle room, the adaptor device comprising:

a signal line inserted between the vehicle-mounted antenna connection terminal and a vehicle-mounted antenna; and an in-vehicle antenna branching out from the signal line, wherein the in-vehicle antenna is a conductor attached to the surface or rear surface of a housing having housed therein the signal line.

9. The adaptor device for a car radio according to claim 8, wherein the in-vehicle antenna is formed in a spiral manner across the surface or rear surface of the housing.

10. The adaptor device for a car radio according to claim 8, wherein the housing is formed by use of a flexible member.

11. An adaptor device for a car radio connected to a vehicle-mounted antenna connection terminal provided in an FM radio receiver installed within a vehicle room, the adaptor device comprising:

a signal line inserted between the vehicle-mounted antenna connection terminal and a vehicle-mounted antenna; and an in-vehicle antenna branching out from the signal line, wherein the in-vehicle antenna is a bar antenna composed of a coil wound around a magnetic core and is disposed within a housing having housed therein the signal line.

12. The adaptor device for a car radio according to claim 11, wherein the housing is formed by use of a flexible member.

* * * * *